US005168258A

United States Patent [19]

Radke

[11] Patent Number: 5,168,258

[45] Date of Patent: Dec. 1, 1992

[54] PROTECTIVE DEVICE FOR PADLOCKS FOR TRUCK CARGO DOORS

[76] Inventor: Glen A. Radke, 7309 Midvale, Yakima, Wash. 98908

[21] Appl. No.: 709,107

[22] Filed: Jun. 3, 1991

[51] Int. Cl.[5] ..... E05B 45/06; G08B 13/08

[52] U.S. Cl. ..... 340/542; 70/54; 70/DIG. 49; 70/DIG. 56; 340/545

[58] Field of Search ..... 340/542-543, 340/545, 568, 825.32; 70/54-56, 211-212, 1.5, 333 A, DIG. 56, DIG. 49, 423; 200/43, 22; 206/1.5, 811; 109/44

[56] References Cited

U.S. PATENT DOCUMENTS

| | | | |
|---|---|---|---|
| 256,902 | 4/1882 | Kirk | 70/56 |
| 1,055,865 | 3/1913 | Boll | 70/56 |
| 1,136,582 | 4/1915 | Birdsong | 70/56 |
| 1,220,941 | 3/1917 | Bowers | 70/56 |
| 2,114,913 | 4/1938 | Crossman | 70/56 |
| 4,033,156 | 7/1977 | Cottingham | 70/56 |
| 4,068,505 | 1/1978 | Volk, Jr. | 70/56 |
| 4,098,102 | 7/1978 | Kalina | 70/DIG. 56 X |
| 4,389,862 | 6/1983 | Hastings | 70/2 |
| 4,541,260 | 9/1985 | Rubinstein et al. | 70/DIG. 49 X |
| 4,566,296 | 1/1986 | Kochakis | 70/56 |
| 4,640,109 | 2/1987 | Schaublin et al. | 70/211 X |
| 4,895,007 | 1/1990 | Eberly | 70/54 |
| 4,901,057 | 2/1990 | Suneborn | 340/542 |
| 5,003,795 | 4/1991 | Hoke | 70/55 |

*Primary Examiner*—Jin F. Ng
*Assistant Examiner*—Thomas J. Mullen, Jr.
*Attorney, Agent, or Firm*—H. Albert Richardson

[57] ABSTRACT

A protective device for a padlock as typically used on the cargo doors of a trailer portion of a truck/trailer combination. Particularly, the device is intended to protect the lock from the environment and to provide a warning of unauthorized access. The preferred embodiment includes a base which is fastened to the door and surrounds the keeper of the lock assembly, a cover pivotally mounted to the base and enclosing the lock, a switch mounted to the cover for detecting displacement of the cover from its closed position and an audible alarm responsive to the switch for emitting a warning signal.

7 Claims, 1 Drawing Sheet

PROTECTIVE DEVICE FOR PADLOCKS FOR TRUCK CARGO DOORS

BACKGROUND OF THE INVENTION

This invention generally relates to protective enclosures and more particularly to an apparatus for protecting a lock from the environment and unauthorized access.

It is common practice to use a key operated padlock to secure the doors on cargo carrying trailers and vans to prevent unauthorized access to the cargo compartments. One common latch assembly used on such doors includes a vertically oriented bar which is slidably mounted in a housing on the exterior surface of the door and which can be extended into cooperating holes in the door frame so as to secure the door in a closed position. The bar is operated by a locking lever which is pivotally mounted to bar housing. The latch assembly also includes means for fixing the locking lever in the locked position including a resting bracket and a pivotally mounted keeper, both of which are attached to the door.

In order to lock the door, the door is first closed and then the lever is rotated upward into a horizontal position causing the locking bar to extend downward into the door frame. Next the keeper is rotated from the vertical sufficiently that the lever can be positioned into the rest bracket and then allowed to return to a vertical position. Finally, the shackle of a padlock is passed through cooperating openings in the lips of the keeper and rest bracket and the lock is closed. A latch assembly of this type is well known to those of ordinary skill in the art.

Because the padlock is exposed to the environment, a number of problems are encountered during operation. One such problem is that during winter driving conditions the locks are directly exposed to precipitation and road spray which may freeze, making the lock very difficult to open. In order to operate trucking lines efficiently it is necessary to minimize turnaround time at terminals. If the truck arrives with a frozen lock the terminal operators may simply resort to cutting the lock off rather than attempting to thaw it. Under other driving conditions the locks are exposed to considerable amounts of dust and dirt which may eventually cause the internal mechanisms to fail.

Another significant problem encountered by trucking lines is theft. With the type of latch assemblies described above the simplest way to gain access to the cargo compartment of a truck is to cut the shackle of the padlock. Numerous mechanical type protection devices for such padlocks are found in the prior art but most of them can be defeated in a few minutes by a thief with simple burglary tools. Also, many of them are undesirable in that they further complicate operation of the locking assembly and are themselves subject to freezing in winter conditions.

Accordingly, it is the object of this invention to provide for a protective device for padlocks used on truck cargo door locking assemblies and similar applications which will shield the padlock from the environment and yet not unduly complicate or hinder its operation.

It is a further object of this invention to provide for a simple and inexpensive alarm system which will warn of unauthorized access to the padlock and in doing so deter theft.

SUMMARY OF THE INVENTION

This invention can be broadly summarized as providing for a protective device for shielding a padlock from the environment and for emitting an alarm signal in the event of unauthorized access. The invention is particularly adapted for use with a latching assembly commonly used on truck and trailer cargo doors which includes a locking bar operable by a pivotally mounted lever. The preferred embodiment includes a cover mounted to the door for movement between open and closed positions and adapted to enclose the padlock. In the closed position the cover will sealably engage the lever and the door. It also includes a means for detecting displacement of the cover away from its closed position and a means responsive to the detecting means for emitting an alarm signal.

In accordance with a more detailed aspect of this invention the detecting means includes an electrical switch mounted to the door which upon a predetermined movement of the cover from its closed position closes the alarm circuitry. Further, the responsive means includes an electrically activated horn for emitting a high intensity audible alarm.

DESCRIPTION OF THE PREFERRED EMBODIMENT

The novel features believed to be characteristic of this invention are set forth in the appended claims. The invention itself, however, may be best understood and its various objects and advantages best appreciated by reference to the detailed description below in connection with the accompanying drawings.

Figure 1:
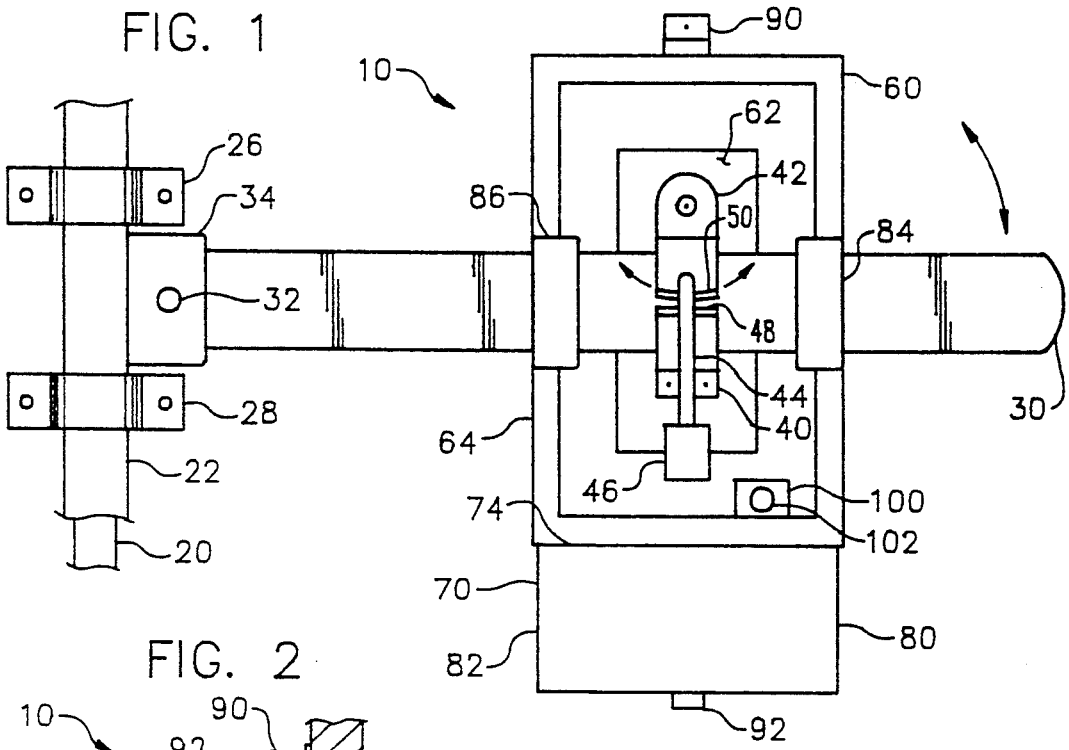
FIG. 1 is a front view of a protective device constructed in accordance with the present invention in which the cover is in an open position.

In FIGS. 1 through 4 of those drawings a protective device constructed in accordance with the teachings of the present invention is illustrated and generally designated by the number 10. It is particularly adapted for use with a latch assembly commonly used for the cargo door of trucks, a portion of which is illustrated in FIG. 1. That latch assembly includes a vertically oriented locking bar 20 which is slidably disposed within tubular bar housing 22. The bar housing is mounted for rotation about its central axis to cargo door 24 by a number of brackets, of which brackets 26 and 28 are typical. Locking lever 30 is pivotally mounted by pin 32 to bracket 34 and the bracket is welded to the housing as shown. The lever extends through a slot in the housing (not shown) and pivotally engages the locking bar so that rotation of the lever about pin 32 will produce vertical motion of the locking bar within the housing.

In the locked position shown in FIG. 1 the locking bar extends downward and through a cooperating hole in the lower frame of the cargo door (not shown) so as to secure the door in a closed position. In that position the locking lever rests horizontally in bracket 40 which is mounted to door 24. Keeper 42, which is pivotally mounted to the door, acts to secure the lever in the bracket. The latch assembly is locked by passing shackle 44 of padlock 46 through opposing holes in lips 48 and 50 of bracket 40 and keeper 42, respectively, and closing the lock.

In order to open the latch the padlock is first opened and removed. Then keeper 42 is rotated in either direction as indicated by the arrows in FIG. 1 and lever 30 is removed from bracket 40. Next the lever and bar housing are rotated sufficiently that the lever can clear the keeper and rest bracket. Finally, the lever is rotated downward sufficiently to withdraw the locking bar from the door frame, permitting the cargo door to be opened. The latching mechanism has been described only briefly as the details of it are well known to those skilled in the art.

Figure 2:
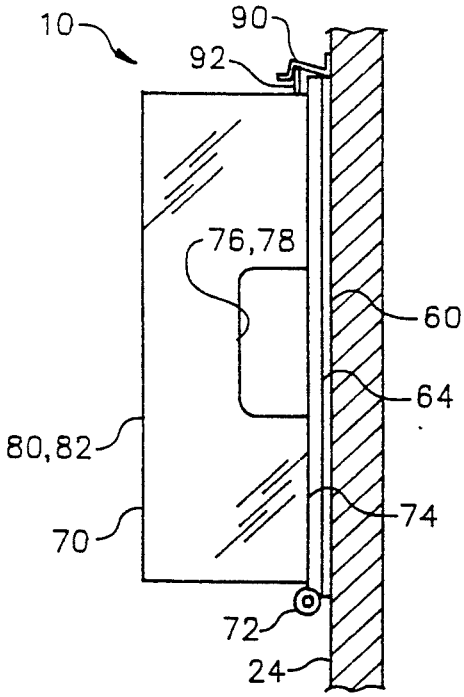
FIG. 2 is a side view of the embodiment of FIG. 1 in which the cover is shown in the closed position and in which the latch assembly has been removed for clarity.

As previously discussed, the primary purpose of this invention is to shield padlock 46 from the environment and to provide a warning if an unauthorized person attempts to access it. The invention includes base 60 which is preferably rectangular in shape and includes centrally located cutout 62. The purpose of the cutout is to permit the base to be installed about bracket 40 and keeper 42. Base gasket 64, which extends completely around and immediately within the periphery of the base, is preferably semi-circular in cross-section and fastened to the base with adhesive. Cover 70 is pivotally mounted to the base by hinge 72 for rotation between a closed position as shown in FIG. 2 and an open position as shown in FIG. 1. The cover is sized and positioned, so that, together with the door, it will enclose the padlocks, resting bracket and keeper. Inner edge 74 of the cover is adapted to sealably engage gasket 64 in the closed position. In order to provide clearance for lever 30 when the latch assembly is locked and the cover is closed, cutouts 76 and 78 are formed in opposing sides 80 and 82, respectively, of the cover. Annular shaped rubber gaskets 84 and 86 are inserted on lever 30 to provide a seal between the cover, the base and the lever when the cover is closed. Spring member 90 mounted to the base and protrusion 92 mounted to the cover provide a means for securing the cover in the closed position.

Figure 3:
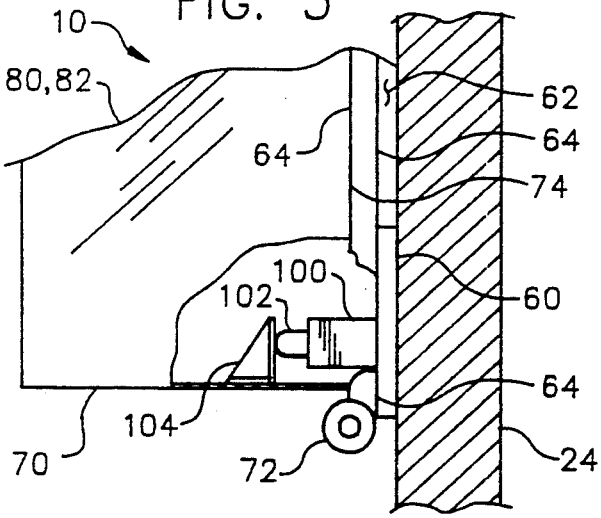
FIG. 3 is an enlarged partial side view of the present invention, partially in section.
Figure 4:
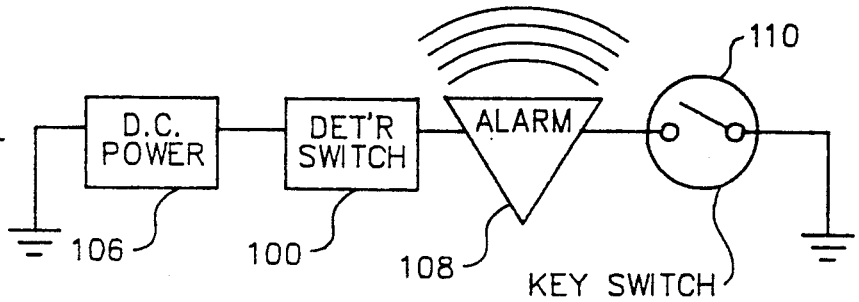
FIG. 4 is a simplified electrical schematic diagram of the present invention.

Preferably, the alarm means includes detector switch 100 which is positioned on the base as shown in FIG. 3. Plunger 102 projects from the switch such that it is depressed by arm 104 when the cover is in the closed position. The switch is configured so that when the cover is closed it is open, whereas when the cover is in the open position it is closed. The alarm system also includes direct current power source 106 which is preferably the primary truck battery, a 115 db electrically powered horn 108 and key switch 110. The key switch is preferably mounted either within the truck cab or in the proximity of the door latch assembly and enables the driver to activate or deactivate the alarm system as desired. The horn should be installed in a protected location such as within the interior of the cargo compartment and directed to transmit to the outside through, for example, a reinforced grill. In order to minimize the possibility that the alarm system could be disabled by severing the electrical conductors attached to the detector switch, the switch could be bridged at a remote location by a latching relay. Failure of the dc power supply from the truck battery could be guarded against by incorporating a backup rechargeable battery in the system that would be activated if the voltage level of the primary battery fell below a certain level. All of these components are electrically interconnected as shown in the schematic diagram of FIG. 4. Other details of the alarm system and the suggested variations therein have not been described in detail as they are well known to those of ordinary skill.

Other obvious variations could be made in the design of the cover. For example, the cover could be removably attached to the door with one or more clips. Further, it could be varied in shape as necessary to accommodate different latch assembly designs. Other means could be used to provide a seal between cutouts 76 and 78 and the latch handle, such as gaskets affixed to the cutouts.

Thus it can be seen that the present invention provides for an improved protective device for a padlock for securing truck cargo doors which incorporates many novel features and offers significant advantages over the prior art. Although only one embodiment of this invention has been illustrated and described, it is to be understood that obvious modifications can be made of it without departing from the true scope and spirit of this invention.

I claim:

1. A protective device for a lock as typically used to secure the latch assembly of the cargo door of a truck, the latch assembly including a locking lever and means for retaining the lever in a locked position, the device comprising:

a cover pivotally mounted to the door for movement between a closed and a open position, the cover being adapted to enclose the lock and sealably engage the door and the lever when the latch assembly is in the locked position and the cover is closed, the cover further including a cutout for providing clearance for the lever;

sealing means disposed between the lever and the cover when the cover is closed and the lever is in the locked position;

means for detecting displacement of the cover from the closed position including an electrical switch; and means responsive to the detecting means for emitting an alarm signal including an audible alarm operably connected to the electrical switch.

2. The device of claim 1 further including a gasket adapted to be disposed between the door and the cover when the cover is in the closed position.

3. The device of claim 1 wherein the electrical switch is mounted to the door and includes an extendible plunger adapted to engage the cover.

4. The device of claim 1 wherein the means for emitting an alarm signal further includes an electrical power source operably connected to the electrical switch and the audible alarm.

5. The apparatus of claim 1 wherein the electrical switch is closable upon a predetermined displacement of the cover from its closed position.

6. The device of claim 1 further including a base attached to the door.

7. A protective device for a lock as typically used to secure the latch assembly of the cargo door of at truck, the device comprising:

a base attached to the door;

a cover pivotally mounted to the base for movement between a closed and an open position, the cover including a cutout providing clearance for the lever and being adapted to enclose the lock and sealably engage the base and the lever when the latch assembly is in the locked position and the cover is closed;

sealing means disposed between the lever and the cover when the cover is closed and the lever is in the locked position;

means for detecting displacement of the cover from the closed position including an electrical switch mounted to the base and having an extendible plunger adapted to engage the cover, the switch closable upon a predetermined displacement of the cover from its closed position; and means responsive to the detecting means for emitting an alarm signal including an electrically actuated horn operably connected to the electrical switch.

* * * * *